United States Patent [19]

Foley et al.

[11] Patent Number: 4,613,557

[45] Date of Patent: Sep. 23, 1986

[54] PHOTORESPONSIVE IMAGING MEMBERS WITH CHEMICALLY MODIFIED PHOTOCONDUCTIVE LAYERS

[75] Inventors: Geoffrey M. T. Foley, Fairport; James M. Markovics, Rochester; John S. Berkes, Webster; Santokh S. Badesha, Pittsford; Martin A. Abkowitz, Webster, all of N.Y.

[73] Assignee: Xerox Corporation, Stamford, Conn.

[21] Appl. No.: 713,219

[22] Filed: Mar. 18, 1985

[51] Int. Cl.[4] ..... G03G 5/10

[52] U.S. Cl. ..... 430/59; 430/62; 430/63; 430/66; 430/84

[58] Field of Search ..... 430/57, 62, 63, 66, 430/84, 95, 59

[56] References Cited

U.S. PATENT DOCUMENTS

| | | | |
|---|---|---|---|
| 2,474,966 | 7/1949 | Addink et al. | 252/62.3 |
| 2,860,954 | 11/1958 | Bucker et al. | 23/209 |
| 4,007,255 | 2/1977 | Buckley | 423/510 |
| 4,009,249 | 2/1977 | Buckley | 423/510 |
| 4,066,455 | 1/1978 | Mey et al. | 430/59 |

OTHER PUBLICATIONS

"Highly Sensitive Chalcogenide Photoconductor in a Near-Infrared Wavelength Region", Taniguchi et al., Journal of Applied Physics, Dec. 1981, 52(12).

"Sensitization of Photoreceptor to Infrared Region by SeTe-Se Double-Layer Structure", Teshima et al., Fujitsu Sci. Tech. Journal, 18,1, pp. 253-265 (Jun. 1982).

"Selenium", edited by R. A. Zingaro & W. C. Cooper, Van Nostrand Reinhold Company, p. 109, 1974.

"Charge Transport in Selenium Based Amorphous Xerographic Photoreceptors", S. O. Kasap & C. Juhasz, Photographic Science and Engineering, vol. 26, No. 5, Sep./Oct. 1982.

*Primary Examiner*—John L. Goodrow

*Attorney, Agent, or Firm*—E. O. Palazzo

[57] ABSTRACT

An improved layered photoresponsive imaging member comprised of a supporting substrate, a photogenerating layer, and an electron transporting layer comprised of an inorganic photoconductive composition chemically modified to enable enhancement of the electron transport properties thereof.

36 Claims, 4 Drawing Figures

PHOTORESPONSIVE IMAGING MEMBERS WITH CHEMICALLY MODIFIED PHOTOCONDUCTIVE LAYERS

This invention is generally directed to layered photoresponsive imaging members or devices, and more specifically, the present invention is directed to improved layered photoresponsive members with certain electron transporting materials. In one embodiment of the present invention there is provided a layered photoresponsive imaging member comprised of a supporting substrate, a photogenerating layer, and an electron transporting layer comprised of chemically modified photoconductive substances, including selenium or selenium alloys, having homogenously or permanently absorbed thereon reducing compositions inclusive of hydrazine. Additionally, the present invention includes within its scope photoresponsive members wherein the electron transporting layer selected has added thereto, or is doped with suitable electron donor molecules for the primary purpose of improving the physical and/or electrical properties thereof. The aforementioned devices are useful for incorporation into various imaging and printing apparatuses, particularly xerographic imaging systems. Further, certain photoresponsive imaging members of the present invention are sensitive to visible light, and infrared radiation, accordingly these members can be used in printing systems wherein helium neon or gallium-arsenide lasers are selected. The presence of the electron transporting layer, as described herein, enables the imaging members of the present invention to possess photosensitivity within the wavelength region of from 400 to 850 nanometers; and further these members permit the generation of high quality images with reduced background. Moreover, with the photoresponsive imaging member of the present invention, the light fatigued dark decay, which results from multiple charging and exposure cycles in the imaging apparatus, can be desirably reduced, particularly when these imaging members are exposed to wavelengths in the red and near infrared region of the spectrum. Additionally, depending on the configuration selected, the imaging members of the present invention are substantially unaffected by corona effluents generated from corotron charging sources, are mechanically superior in many instances to degradation by abrasion when compared to organic layered imaging members, and are not adversely affected in most instances by chemical solvents inclusive of those present in liquid immersion development inks.

Numerous different xerographic photoconductors are known including, for example, a homogeneous layer of a single material such as vitreous selenium, or a composite layered device containing a dispersion of a photoconductive composition. An example of one type of composite xerographic device is described, for example, in U.S. Pat. No. 3,121,006, wherein there is illustrated finely divided particles of a photoconductive inorganic compound dispersed in an electrically insulating organic resinous binder. In a commercial form, the binder layer is comprised of particles of zinc oxide uniformly dispersed in a resinous binder and coated with a paper backing. The binder materials disclosed in this patent comprise a composition which is incapable of transporting for any significant distance injected charge carriers generated by the photoconductive particles. Illustrative examples of specific binder materials disclosed include polycarbonate resins, polyester resins, polyamide resins, and the like.

Moreover, there are known photoreceptor materials comprised of inorganic or organic materials wherein the charge carrier generation and charge carrier transport functions are accomplished by discrete layers. Additionally, photoreceptor members are disclosed in the prior art which include an overcoating layer of an electrically insulating polymeric material; and in conjunction with this overcoated type photoreceptor, there have been proposed a number of imaging methods. However, the art of xerography continues to advance and more stringent demands need to be met by the copying apparatus in order to increase performance standards, and to obtain higher quality images. Also, there is needed improved photoresponsive imaging members which are sensitive in wavelength regions extending through the visible region of the spectrum. Furthermore, there is a need for improved photoresponsive imaging members which are sensitive to wavelengths in excess of about 800 nanometers. The photoresponsive imaging member of the present invention, depending on the configuration selected, meets these objectives. Also, photoresponsive imaging members are desired which are sensitive in a wavelength region extending from the visible, about 400 nanometers, to the near infrared, in excess of about 800 nanometers. The photoconductive imaging members of the present invention, depending on the configuration selected, achieve these objectives, and have other advantages as disclosed herein.

Recently, there has been disclosed photoresponsive members comprised of photogenerating layers, and transport layers, reference U.S. Pat. No. 4,265,990, and overcoated photoresponsive members with a hole injecting layer, in contact with a transport layer, followed by an overcoating of a photogenerating layer, and a top coating of an insulating organic resin, reference U.S. Pat. No. 4,251,612. Examples of photogenerating materials disclosed in these patents include trigonal selenium and phthalocyanines, while examples of the transport substances that may be used, which compositions transport positive charges in contrast to the chemically treated transport layers of the present invention which transport electrons, include certain diamines dispersed in a resinous binder. The disclosures of each of these patents, namely, U.S. Pat. Nos. 4,265,990 and 4,252,612 are totally incorporated herein by reference. Other representative patents disclosing layered photoresponsive devices include U.S. Pat. Nos. 4,115,116, 4,047,949 and 4,081,274.

Furthermore, there is disclosed in U.S. Pat. Nos. 4,232,102 and 4,233,383 photoresponsive imaging members comprised of trigonal selenium doped with sodium carbonate, sodium selenium doped with sodium carbonate, sodium selenite mixtures, and barium carbonate, barium selenite mixtures.

Also of interest is U.S. Pat. No. 3,041,167, which describes an electrophotographic imaging member with a conductive substrate, a photoconductive insulating layer, and an overcoating layer of an electrically insulating polymeric material. This member is utilized in an electrophotographic copying method by, for example, initially charging the member with an electrostatic charge of a first polarity, and imagewise exposing to form an electrostatic latent image which can be subsequently developed to form a visible image. Prior to each succeeding imaging cycle, the imaging member can be charged with an electrostatic charge of a second polarity which is opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential which is developed to form the visible image is present across the photoconductive layer and the overcoating layer.

There is also described in U.S. Pat. No. 4,474,865 an improved layered photoresponsive imaging member comprised of a supporting substrate, a photogenerating layer, and in contact with the photogenerating layer an electron transporting layer comprised of derivatives of fluorenylidenemethane. Furthermore, disclosed in U.S. Pat. No. 4,415,639 are infrared photoresponsive members comprised, for example, of (1) a substrate; (2) a hole blocking layer; (3) an optional adhesion interface layer; (4) a photogenerating layer; (5) a composition capable of enhancing or reducing the intrinsic properties of the photogenerating layer, which composition is selected from the group consisting of organic photoconductive materials, charge transfer complex materials, and sensitizers; and (6) a hole transport layer. The imaging members disclosed in the aforementioned patent may be negatively or positively charged, exposed to light in a wavelength region of from about 400 to about 1,000 nanometers, either sequentially or simultaneously, followed by developing the resulting image, and transferring to paper.

While the above-described photoresponsive members are suitable for their intended purposes, there continues to be a need for improved members which not only generate acceptable images, but which can be repeatedly used in a number of imaging cycles without deterioration thereof from the machine environment or surrounding conditions; and wherein these members, depending on the configuration selected, are sensitive to wavelengths in the near infrared region of the spectrum, and to visible light thus enabling them to be useful in a number of imaging and printing systems. Additionally, there continues to be a need for improved layered imaging members with an electron transporting substance rather than hole transporting substances, which members are useful for selection in repetitive imaging and printing systems, and wherein certain of these members are sensitive to wavelengths of from about 400 to about 850 nanometers. Moreover, there continues to be a need for improved layered imaging members wherein the electron transporting layer is situated between a photogenerating layer and a supporting substrate, or wherein a photogenerating layer is situated between an electron transporting layer and a supporting substrate enabling the generation of images with reduced dark decay, and wherein the members involved are sensitive to visible light and infrared radiation. Additionally, the imaging members of the present invention can be positively charged, or negatively charged, depending on the configuration selected.

SUMMARY OF THE INVENTION

It is therefore an object of the present invention to provide improved photoresponsive imaging members which overcome many of the above-noted disadvantages.

It is yet another object of the present invention to provide layered photoresponsive imaging members with electron transporting substances.

A further specific object of the present invention is the provision of layered photoresponsive imaging members comprised of a photogenerating layer, and in contact therewith an electron transporting layer comprised of chemically modified photoconductive electron transporting materials.

In still another object of the present invention there are provided layered photoresponsive imaging members with a photogenerating layer, and in contact therewith an electron transporting layer comprising electron transporting compositions optionally doped with suitable electron donor molecules.

In another object of the present invention there are provided specific improved layered photoresponsive imaging members which are panchromatic, and thus sensitive to visible light as well as near infrared light.

In a further object of the present invention there are provided specific improved layered photoresponsive imaging members which are sensitive to visible light.

In an additional object of the present invention there are provided specific improved layered photoresponsive imaging members which are sensitive to infrared light.

In another object of the present invention there are provided imaging methods, and printing methods with the improved layered photoresponsive imaging members of the present invention.

These and other objects of the present invention are accomplished by the provision of an improved photoresponsive imaging member comprised of a photogenerating layer and an electron transporting layer in contact therewith. More specifically, the present invention is directed to an improved layered photoresponsive imaging member comprised of a supporting substrate, an inorganic or organic photogenerating layer, and an electron transporting layer comprised of chemically modified, or chemically treated inorganic photoconductive materials, including those materials having homogeneously and permanently absorbed thereon a reducing composition such as hydrazine.

In one specific embodiment of the present invention, there are provided negatively charged photoresponsive imaging members comprised of a supporting substrate, an electron transporting layer comprised of chemically modified or chemically treated inorganic photoconductive material, a thin photogenerating layer, from about 0.1 micron to about 1 micron, of known inorganic photogenerating pigments excluding amorphous selenium and trigonal selenium, and an overcoating preferably of a silicone resin, reference U.S. Pat. No. 4,371,600, disclosure of which is totally incorporated herein by reference.

A further specific negatively charged imaging member of the present invention is comprised of a supporting substrate, an electron transporting layer comprised of chemically modified or chemically treated inorganic photoconductive materials, which layer is in contact with the supporting substrate; and a top layer in a thickness of from about 1 micron to about 5 microns of a photogenerating layer comprised of chemically modified or chemically treated selenium tellurium alloys with from about 5 percent by weight to about 45 percent by weight of tellurium. By chemically modified in this context is intended to include a selenium tellurium alloy having homogeneously and permanently absorbed thereon a reducing composition such as hydrazine.

Also, encompassed within the scope of the present invention are positively charged layered photoresponsive imaging members comprised of a supporting substrate, a photogenerating layer with thickness of from about 1 micron to about 5 microns, comprised of photogenerating compounds sensitive to infrared wavelengths, inclusive of vanadyl phthalocyaine, and selenium tellurium alloys with a tellurium alloy content of at least 35 percent by weight; and a top coating of an electron transporting layer comprised of chemically modified or chemically treated inorganic photoconductive materials having homogeneously and permanently absorbed thereon a reducing composition such as hydrazine.

Furthermore, there is included within the present invention a positively charged layered photoresponsive imaging member comprised of a transparent substrate, about 80 percent transmission value, a thin photogenerating layer, with a thickness of from about 0.1 micron to about 1 micron, and comprised of inorganic photogenerating pigments inclusive of amorphous selenium, and an electron transporting layer comprised of an inorganic photoconductive compound having homogeneously and permanently absorbed thereon a reducing composition.

In another embodiment of the present invention there are provided improved photoresponsive imaging members comprised of electron transporting layers comprised of inorganic photogenerating substances chemically modified with hydrazine, generated by the reduction of the corresponding pure esters with sulfur dioxide or hydrazine, or wherein these layers are obtained by hydrogen sparging, or by a reduction reaction with ammonia and photogenerating layers.

An additional specific embodiment of the present invention relates to improved photoresponsive imaging members comprised of an electron transporting layer situated between a photogenerating layer and a supporting substrate, or wherein the photogenerating layer is situated between a supporting substrate and the electron transporting layer. In the aforementioned members, the photogenerating layer comprises inorganic or organic photogenerating compositions, and the electron transporting layer is comprised of chemically modified or chemically treated inorganic photoconductive materials, including those having homogeneously and permanently absorbed thereon the reducing composition hydrazine. Moreover, the electron transporting layer can be chemically modified by preparing this layer from the corresponding pure esters of the inorganic photoconductive materials wherein reduction is affected with sulfur dioxide or hydrazine, or wherein the inorganic photoconductive substances are obtained from hydrogen sparging.

The improved photoresponsive imaging members of the present invention can be prepared by a number of known methods, the process parameters and the order of the coating of the layers being dependent on the member desired. Thus, for example, the improved photoresponsive imaging member of the present invention can be prepared by providing a conductive substrate; and applying thereto by solvent coating processes laminating processes or other methods, a photogenerating layer, followed by the application of the electron transporting layer by high temperature evaporation techniques.

Also, the improved photoresponsive imaging member of the present invention can be incorporated into various imaging systems, and more importantly, in certain configurations, can function simultaneously in imaging and printing systems with visible light and/or infrared light. Thus the improved photoresponsive members of the present invention may be negatively charged, or positively charged depending on the chosen device configuration; exposed to light in the wavelength region of from about 400 to about 1,000 nanometers, in some configurations, either sequentially or simultaneously; followed by developing the resultant image; and transferring this image to paper.

DESCRIPTION OF THE PREFERRED EMBODIMENTS

Figure 1:
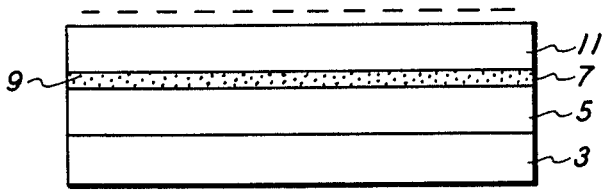
Figure 2:
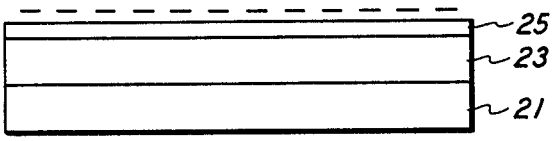
Figure 3:
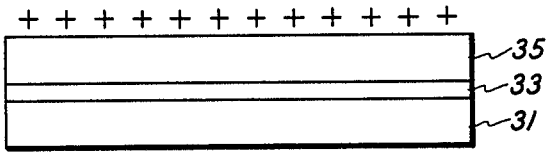
Figure 4:
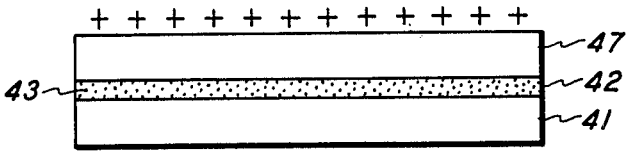

For a better understanding of the present invention and further features thereof, reference is made to the following detailed description of various preferred embodiments wherein:

FIG. 1 is a partially schematic cross-sectional view of the improved photoresponsive imaging member of the present invention; and FIGS. 2, 3, and 4 are partially schematic cross-sectional views of the improved photoresponsive imaging members of the present invention.

Illustrated in FIG. 1 is an improved negatively charged photoresponsive imaging member of the present invention generally designated 10, and comprising a supporting substrate 3; an electron transporting layer 5; comprised of chemically treated or chemically modified inorganic photoconductive compounds having homogeneously and permanently absorbed thereon a reducing composition; a thin photogenerating layer 7, comprised of an inorganic photogenerating pigment excluding amorphous selenium and trigonal selenium, which pigments may be optionally dispersed in a resinous binder 9; and an overcoating 11 in a thickness of 1 micron, comprised of a silicone resin. These devices are primarily useful as photoresponsive imaging members that are sensitive to wavelengths in the visible region, and the near infrared region. Accordingly, the aforementioned imaging members have incorporated therein photogenerating pigments sensitive to infrared wavelengths can be selected for obtaining images with helium neon lasers, and gallium arsenide lasers.

There is illustrated in FIG. 2 an improved negatively charged photoresponsive imaging member of the present invention comprised of a supporting substrate 21; an electron transporting layer 23, comprised of inorganic photoconductive compounds having homogeneously and permanently absorbed thereon a reducing composition; a photogenerating layer 25 of a thickness of from about 1 micron to about 5 microns, and comprised of a selenium tellurium alloy containing from about 5 weight percent tellurium to about 45 weight percent tellurium, having homogeneously and permanently absorbed on the surface thereof a reducing composition. Depending on the specific photogenerating compositions selected, the imaging member of FIG. 2 is sensitive to wavelengths in the visible and near infrared region of the spectrum similar to the imaging member as described, for example, with reference to FIG. 1.

Illustrated in FIG. 3 is a positively charged improved photoresponsive imaging member of the present invention comprised of a supporting substrate 31, a photogenerating layer 33 of a thickness of from about 1 micron to about 5 microns comprised of photogenerating pigments sensitive to infrared wavelengths including metal phthalocyanines, metal free phthalocyanines, vanadyl phthalocyanines, and selenium tellurium alloys with at least about 35 percent by weight of tellurium; and an electron transporting layer 35 comprised of an inorganic photoconductive compound having homogeneously and permanently absorbed thereon a reducing composition. The positively charged imaging member of this Figure is sensitive to infrared wavelengths thereby enabling the use, for example, of gallium arsenide lasers.

Illustrated in FIG. 4 is a positively charged improved photoresponsive imaging member of the present invention comprised of a transparent supporting substrate 41, which has at least an 80 percent transmission value, such as Mylar; a thin photogenerating layer 42 about 0.1 micron to 1 micron in thickness comprised of photogenerating pigments optionally dispersed in active resinous binders 43; and an electron transporting layer 47 comprised of an inorganic photoconductive material having homogeneously and permanently absorbed thereon reducing compositions inclusive of hydrazine and sulfur dioxide. These members are sensitive to visible light, and infrared light depending on the selection of the photogenerating pigment.

The supporting substrate layers are as illustrated herein with reference to FIGS. 1 through 4, thus the substrate may be opaque or substantially transparent, reference FIG. 4, and can be selected from any suitable material having the requisite mechanical properties. Accordingly, the supporting substrate may comprise a layer of insulating, or non-conducting material such as inorganic or organic polymeric material; a layer of an organic or inorganic material having a semiconductive surface layer arranged thereon such as indium tin oxide; or a conductive material such as, for example, aluminum, chromium, nickel, brass or the like. The substrate can thus be comprised of a polymeric material, particularly aluminized Mylar, which is commercially available. Further, the substrate may be flexible or rigid and many have any of many different configurations such as, for example, a plate, a cylindrical drum, a scroll, or an endless flexible belt.

The thickness of the supporting substrate depends on many factors, including economical considerations, therefore, this layer may be of substantial thickness, for example, over 2,500 microns or of minimum thickness providing there are no adverse effects on the imaging member. In one preferred embodiment, the thickness of this layer is from about 75 microns to about 250 microns.

Also, the photogenerating layers are as illustrated herein with reference to FIGS. 1 through 4, and thus can be comprised of known photoconductive charge carrier generating materials sensitive to visible light such as amorphous selenium, tellurium, amorphous selenium alloys, halogen doped amorphous selenium, halogen doped amorphous selenium alloys, trigonal selenium, mixtures of Groups IA and IIA elements, selenite and carbonates with trigonal selenium, reference U.S. Pat. Nos. 4,232,102 and 4,233,283, copper, and chlorine doped cadmium sulfide, cadmium selenide, and cadmium sulfur selenide, metal phthalocyanines, metal free phthalocyanines, vanadyl phthalocyanines and the like. Alloys of selenium included within the scope of the present invention include selenium tellurium alloys, selenium arsenic alloys, selenium-arsenic-tellurium alloys, and the chemically modified forms of the preceding alloys, and preferably such alloys containing a halogen material such as chlorine in an amount of from about 50 to 200 parts per million. Preferred photogenerating substances are amorphous selenium, trigonal selenium, and alloys of selenium arsenic, wherein the amount of selenium present is from about 95 percent to about 99.5 percent by weight, and the amount of arsenic present is from about 0.5 percent by weight to about 5 percent by weight. Preferred selenium tellurium alloys include those with a high content of tellurium, that is, about 35 percent by weight as indicated hereinbefore. With respect to the photogenerating pigments, it is important that these compounds be selected in accordance with the description as provided with respect to FIGS. 1 through 4. Thus, for example, with respect to FIG. 1, excluded as photogenerating pigments are amorphous selenium and trigonal selenium. With respect to FIG. 2, photogenerators are restricted to the chemically modified forms of the selenium and tellurium alloys illustrated herein; while with respect to FIG. 3, the photogenerating layers are comprised of photogenerating pigments which are sensitive in the infrared region of the spectrum, inclusive of metal phthalocyanines, metal free phthalocyanines, vanadyl phthalocyanines, and selenium tellurium alloys with about 35 percent by weight of tellurium. Moreover, with respect to FIG. 4, the photogenerating pigment can be comprised of virtually any known photogenerating compounds inclusive of amorphous selenium and trigonal selenium, providing the objectives of the present invention are achieved. Additionally, with further regard to FIG. 4, the supporting substrate is comprised of a polymeric substance, which is transparent, such as Mylar, these substrates having about an 80 percent transmission characteristic.

The thickness of the photogenerating layer is dependent on the configuration selected for the photoresponsive imaging member of the present invention. Accordingly, thus as indicated hereinbefore, the thickness of the photogenerating layer with respect to the configuration of FIG. 1 is from about 0.1 micron to about 1 micron; about 1 micron to about 5 microns for the configuration of FIGS. 2 and 3; and from about 0.1 micron to about 1 micron for the FIG. 4 configuration.

Examples of electron transporting compositions useful in the electron transport layer of the imaging members illustrated herein include selenium, or selenium alloys, containing homogenously and permanently absorbed on the surface thereof reducing substances. More specifically, the electron transporting substance is obtained by a process which comprises (1) providing a source of selenium, or selenium alloy; (2) treating the selenium, or selenium alloy with hydrazine in an amount of from 0.1 percent by volume to about 15 percent by volume at a temperature of from about 50 degrees centigrade to about 120 degrees centigrade; and (3) continuing the treatment for a period of time sufficient to cause the hydrazine to be homogeneously and permanently absorbed on the surface of the selenium, or selenium alloy. In accordance with this process there results a selenium, or selenium alloy product wherein the electron transporting properties have been significantly increased, as compared to selenium alloys or selenium which have not been surface treated in accordance with the process described. With this process a selenium or selenium alloy product with extended electron transporting properties, or extended electron range capabilities, is obtained. While it is not desired to be limited by theory, it is believed that the hydrazine is simply absorbed on the surface of the selenium, or selenium alloy. Further, it is believed that the hydrazine functions as a Lewis Base causing holes or positive charges to be trapped, while at the same time permitting electrons to be transported in the selenium or selenium alloy. The details of this process are described in copending application U.S. Ser. No. 500,504, now U.S. Pat. No. 4,520,010, entitled Process for Modifying the Electrical Properties of Selenium, and Selenium Alloys, the disclosure of which is totally incorporated herein by reference.

More specifically, there is described in the aforementioned copending application a process for improving the electron transporting properties of selenium, or selenium alloys, which comprises (1) providing a source of selenium, or selenium alloy; (2) treating the selenium, or selenium alloy with hydrazine contained in an organic solvent in an amount of from about 0.1 percent by volume to about 15 percent by volume; and (3) heating the resulting mixture to a temperature of from about 50 degrees centigrade to about 120 degrees centigrade, wherein there results a selenium or selenium alloy have homogeneously and permanently absorbed thereon hydrazine.

With further respect to the electron transport layer, it can be specifically prepared by surface treating commercially available selenium, or selenium alloys with a reducing agent such as hydrazine, by adding the selenium or selenium alloy in an amount of from about 10 grams to about 1,000 grams to a solution of hydrazine dissolved in an organic solvent such as cellosolve. This solution, which contains from about 0.1 percent by volume to about 15 percent by volume of hydrazine, is mixed while simultaneously being heated to a temperature of from about 50 degrees centigrade to about 120 degrees centigrade, and preferably from about 60 degrees centigrade to about 80 degrees centigrade. The reaction mixture is then allowed to cool, and the selenium or selenium alloy is separated therefrom by known filtration techniques wherein there results on the surface of the material being treated hydrazine. This hydrazine is homogeneously and permanently absorbed on the surface of the selenium, or selenium alloy as evidenced, for example, by the significant increase in the electron transporting properties of the surface treated materials as compared to untreated materials.

In addition to hydrazine there can be selected as the surface treating material to be absorbed other aliphatic and aromatic amines inclusive of pyridine, aniline, pyroline, pyridine alkylamines, and the like. The treating material is present as a solution mixture with an organic solvent, such as cellosolve, ethanol, benzene, toluene, or dioxane, and the like. Generally, the surface active treating substance is present in the organic solvent in an amount of from about 0.1 percent by volume to about 15 percent by volume, and preferably in an amount of from about 1 percent by volume to about 10 percent by volume. The solution is vigorously stirred and shortly subsequent thereto there is slowly added an effective amount of the selenium or selenium alloy, this addition occurring over a period of from about one minute to about five minutes. The resulting solution containing the selenium, or selenium alloy is then heated to a temperature of about 50 degrees centigrade for about five minutes. After cooling to room temperature, the treated material is filtered from the solution by known filtration techniques including, for example, water suction. The resulting separated product can then be washed with an organic solvent such as cellosolve. The product is allowed to dry and there results a selenium, or selenium alloy having homogeneously absorbed on its surface the hydrazine.

The thickness of the electron transporting layer is primarily dependent on the configuration of the imaging members selected. Generally, the electron transporting layer has a thickness of from about 5 microns to about 100 microns, and preferably is of a thickness of 60 microns.

Although it is not desired to be limited by theory, the photoresponsive imaging member as illustrated in FIG. 1 functions by initially negatively charging this member by the deposition of ions from a negative corona source. These ions are transported through the top overcoating and are believed to be trapped at the interface between the overcoat and the photogenerating layer. Equivalent positive countercharge resides at the substrate interface layer. Thereafter, imagewise illumination of the photoresponsive imaging member by visible light or by a scanning laser generating light in the red or near infrared wavelength regions results in imagewise photo discharge of the member in the illuminated regions. This occurs as a result of electron hole pair production in the photogenerating layer, injection of electrons into the transport layer, transport of electrons through the aforementioned layer, and neutralization of the positive countercharge. Neutralization of the negative charge at the top overcoating layer occurs in view of the corresponding photogenerated holes. Also, elimination of any residual surface charge may be accomplished prior to recharging the member for the next imaging cycle by uniform illumination thereof with light to a wavelength region in which the photogenerating layer is sensitive.

The imaging member of FIG. 2 operates substantially in the manner as described herein with reference to FIG. 1. With reference to FIG. 3, the operation is similar to the description as provided herein with respect to FIG. 1 with the primary exception that the member is positively charged by the deposition of ions from a positive corona source. Likewise, the imaging member of FIG. 4 operates in substantially the same manner as described herein with reference to FIG. 3 with the primary exception that in FIG. 4 the substrate is transparent, and therefore exposure occurs through the substrate rather than at the top of the imaging member as detailed in FIG. 3.

The following examples further define certain embodiments of the present invention, particularly those embodiments wherein the imaging member is negatively charged, it being noted that these examples are intended to be illustrative only and are not intended to limit the scope of the present invention. Parts and percentages are by weight unless otherwise indicated.

EXAMPLE I

There was prepared an electron transporting layer by adding 60 grams of amorphous selenium powder, commercially available from Fischers Scientific, to 500 milliliters of a solution containing 1 percent by value of hydrazine in the organic solvent cellosolve. The resulting slurry was vigorously stirred and simultaneously heated at 120 degrees centigrade for two minutes. Subsequently, the reaction mixture was allowed to cool to room temperature, and a black selenium precipitate was separated therefrom by filtration. The black selenium precipitate containing hydrazine absorbed on its surface was then washed several times to remove traces of hydrazine, and thereafter the product was dried under a vacuum for ten minutes.

In a similar manner, selenium containing sulfur dioxide absorbed on its surface can be prepared.

EXAMPLE II

There was prepared a layered photoresponsive imaging member by providing an aluminum substrate of 1,500 microns in a thickness which was subjected to cleaning with a methylene chloride solvent followed by washing with dionized water and air drying. These was then coated thereover by evaporation under high vacuum a photoconductive layer of a selenium tellurium alloy comprised of 41 percent by weight of tellurium. There results a photogenerating layer of a thickness of 0.5 microns. Thereafter, there was then evaporated on the photogenerating layer a transport layer in a thickness of 23 microns using conventionally prepared commercially available selenium obtained from Canadian Copper Refiners (CCR). The substrate was held at 65° C. during the evaporations.

EXAMPLE III

A photoresponsive imaging member was prepared by repeating the procedure of Example II with the exception that there was selected as the transport layer in a thickness of 20 microns, hydrazine modified selenium as prepared in accordance with Example I.

EXAMPLE IV

A photoresponsive imaging member was prepared by repeating the procedure of Example II with the exception that there was selected as the transport layer in a thickness of 20 microns, sulfur dioxide reduced selenium as prepared in accordance with Example I.

EXAMPLE V

The photoresponsive imaging member as prepared in accordance with Examples II to IV were individually charged in a reciprocating stage cycling device with a voltage probe, a positive corona charge device, a light fiber illuminator, and a second noncontact voltage probe. Each cycle consisted of passing under the active corotron the photoresponsive imaging member for the purpose of charging this member causing movement past the shuttered closed light fiber to a momentary rest under the voltage probe ($V_o$), then a return passage under the shuttered open light fiber to light expose erase the sample, followed by movement past the inactive corotron to a momentary rest under $V_R$, (residual) voltage probe. Subsequent to the first half cycle, wherein the photoresponsive imaging members were initially charged but not erased, the initial dark decay was monitored for five minutes. Thereafter, the imaging members were subjected to 300 cycles of charge and (red) light erase. Movement of the imaging member in each instance is terminated under the $V_o$ probe subsequent to the last charge cycle prior to erasure, and the fatigue dark decay monitored. The following Table summarizes the results:

| Imaging Member | $V_o$ (Initial) | Dark Decay Initial | Dark Decay Fatigued | Ratio (Fatigued/ Rested) |
|---|---|---|---|---|
| Hole Transporting Material (CCR—Se) | +290 volts | 1 v/sec | 1 v/sec | 10 |
| Hydrazine Modified Se Transport Layer | +210 volts | 1 v/sec | 4 v/sec | 4 |
| $SO_2$ Modified Se Transport Layer | +260 volts | 1 v/sec | 1.7 v/sec | 1.7 |

A fatigued dark decay of 10 volts per second compares unfavorably with a dark decay fatigue of 4 volts per second and 1.7 volts per second in that large dark decay in the image potential reduces the xerographic contrast potential for development.

Also, a fatigue/rested ratio of 10 compares unfavorably with that of a fatigue/rested ratio of 4 and 1.7 in that, for example, a lower ratio increases the xerographic system latitude against dark development potential cycle down which may also occur in an imagewise fashion.

Other modifications of the present invention will occur to those skilled in the art based upon a reading of the present disclosure. These are intended to be included within the scope of this invention.

We claim:

1. An improved layered photoresponsive imaging member comprised of a supporting substrate, a photogenerating layer, and an electron transporting layer comprised of a chemically modified inorganic photoconductive composition enabling enhancement of the electron transport properties thereof.

2. An improved imaging member in accordance with claim 1 wherein the transport layer material is chemically modified with hydrazine or sulfur dioxide.

3. An imaging member in accordance with claim 1 wherein the electron transporting layer material is modified by generating this layer from the reduction reaction of the corresponding pure esters of the photoconductive composition with sulfur dioxide or hydrazine.

4. An imaging member in accordance with claim 1 wherein the electron transporting layer material is chemically modified by hydrogen sparging.

5. An imaging member in accordance with claim 1 wherein the electron transporting layer is situated between the photogenerating layer and supporting substrate.

6. An imaging member in accordance with claim 1 wherein the photogenerating layer is situated between the supporting substrate and the electron transporting layer.

7. An imaging member in accordance with claim 1 wherein the supporting substrate is transparent.

8. An improved layered photoresponsive imaging member comprised of a supporting substrate, a photogenerating layer, and an electron transporting layer comprised of a chemically modified electron transporting inorganic photoconductive compound which is prepared by (1) providing a source of selenium, or selenium alloy; (2) treating the selenium, or selenium alloy with hydrazine contained in an organic solvent in an amount of from about 0.1 percent by volume; and (3) heating the resulting mixture to a temperature of from about 50 degrees centigrade to about 120 degrees centigrade, wherein there results a selenium or selenium alloy with hydrazine permanently absorbed thereon.

9. An improved photoresponsive imaging member in accordance with claim 8 wherein the photogenerating layer is situated between the electron transporting layer and the supporting substrate.

10. An improved photoresponsive imaging member in accordance with claim 8 wherein the electron transporting layer is situated between the photogenerating layer and the supporting substrate.

11. An improved photoresponsive imaging member in accordance with claim 8 wherein the photogenerating pigment is dispersed in a resinous binder in an amount of from about 5 percent by weight to about 95 percent by weight.

12. A negatively charged photoresponsive imaging member comprised of a supporting substrate, an electron transporting layer comprised of an electron transporting compounds having homogeneously and permanently absorbed thereon hydrazine or sulfur dioxide, a photogenerating layer in a thickness of from about 0.1 micron to about 1 micron; and comprised of pigments sensitive to visible light and/or infrared wavelengths, excluding amorphous selenium and trigonal selenium; and a protective overcoating layer.

13. An improved imaging member in accordance with claim 12 wherein the electron transporting layer is comprised of a selenium or selenium alloy with hydrazine permanently absorbed thereon.

14. An improved imaging member in accordance with claim 12 wherein the photogenerating layer is selected from the group consisting of metal phthalocyanines, metal free phthalocyanines, and vanadyl phthalocyanines.

15. An improved imaging member in accordance with claim 12 wherein the protective overcoating is a silicone resin.

16. An improved negatively charged photoresponsive imaging member comprised of a supporting substrate, an electron transporting layer comprised of an electron transporting photoconductive compound having permanently absorbed thereon hydrazine or sulfur dioxide; a photogenerating layer of a thickness of from about 1 micron to about 5 microns; and comprised of a selenium tellurium alloy with from about 5 weight percent tellurium to 45 weight percent tellurium, which photogenerating pigments have hydrazine permanently absorbed thereon.

17. An improved photoresponsive imaging member in accordance with claim 16 wherein the electron transporting compound is a selenium or selenium alloy with hydrazine permanently absorbed thereon.

18. An improved photoresponsive imaging member in accordance with claim 16 wherein the thickness of the photogenerating layer is 1 micron.

19. An improved positively charged photoresponsive imaging member comprised of a supporting substrate; a photogenerating layer of a thickness of from about 1 micron to about 5 microns comprised of photogenerating pigments sensitive to near infrared wavelengths; and an electron transporting layer comprised of an inorganic photoconductive compound with a reducing composition permanently absorbed thereon.

20. An improved photoresponsive imaging member in accordance with claim 19 wherein the electron transporting compound is a selenium or selenium alloy with hydrazine permanently absorbed thereon.

21. An improved photoresponsive imaging member in accordance with claim 19 wherein the photogenerating pigment is a metal phthalocyanine, a metal free phthalocyanine or vanadyl phthalocyanine.

22. An improved photoresponsive imaging member in accordance with claim 19 wherein the photogenerating layer is a thickness of about 0.1 micron to about 1 micron, and is comprised of inorganic photogenerating pigments.

23. An improved photoresponsive imaging member in accordance with claim 19 wherein the photogenerating pigments are comprised of inorganic photogenerating pigments or organic photogenerating pigments.

24. An improved photoresponsive imaging member in accordance with claim 19 wherein the inorganic photogenerating pigments are amorphous selenium, trigonal selenium, selenium arsenic alloys, or selenium tellurium alloys.

25. An improved photoresponsive imaging member in accordance with claim 19 wherein the organic photogenerating pigments are selected from the group consisting of metal phthalocyanines, metal free phthalocyanines or vanadyl phthalocyanines.

26. An improved positively charged photoresponsive imaging member comprised of a transparent substrate; an electron transporting layer comprised of inorganic photoconductive compound with a reducing compound permanently absorbed thereon, and a photogenerating layer.

27. An improved photoresponsive imaging member in accordance with claim 21 wherein the supporting substrate has an 80 percent transmission value.

28. An improved photoresponsive imaging member in accordance with claim 1 wherein the photogenerating pigments are comprised of inorganic photogenerating pigments or organic photogenerating pigments.

29. An improved photoresponsive imaging member in accordance with claim 28 wherein the inorganic photogenerating pigments are amorphous selenium, trigonal selenium, selenium arsenic alloys, or selenium tellurium alloys.

30. An improved photoresponsive imaging member in accordance with claim 28 wherein the organic photogenerating pigments are selected from the group consisting of metal phthalocyanines, metal free phthalocyanines or vanadyl phthalocyanines.

31. An improved photoresponsive imaging member in accordance with claim 1 wherein the photogenerating layer is a thickness of about 0.1 micron to about 1 micron, and is comprised of inorganic photogenerating pigments.

32. An improved photoresponsive imaging member in accordance with claim 16 wherein the photogenerating layer is a thickness of about 0.1 micron to about 1 micron, and is comprised of inorganic photogenerating pigments.

33. An improved photoresponsive imaging member in accordance with claim 16 wherein the photogenerating pigments are comprised of inorganic photogenerating pigments or organic photogenerating pigments.

34. An improved photoresponsive imaging member in accordance with claim 33 wherein the inorganic photogenerating pigments are amorphous selenium, trigonal selenium, selenium arsenic alloys, or selenium tellurium alloys.

35. An improved photoresponsive imaging member in accordance with claim 33 wherein the organic photogenerating pigments are selected from the group consisting of metal phthalocyanines, metal free phthalocyanines or vanadyl phthalocyanines.

36. An improved layered photoresponsive imaging member consisting essentially of a supporting substrate, a photogenerating layer, and an electron transporting layer consisting essentially of an inorganic photoconductive composition having absorbed thereon hydrazine or sulfur dioxide enabling enhancement of the electron transport properties thereof.

* * * * *